US009980037B2

(12) United States Patent
Miwa et al.

(10) Patent No.: US 9,980,037 B2
(45) Date of Patent: May 22, 2018

(54) SPEAKER AND HEADPHONE DEVICE

(71) Applicant: JVC KENWOOD CORPORATION, Yokohama-shi, Kanagawa (JP)

(72) Inventors: Yasuhiro Miwa, Yokohama (JP); Hikaru Nagata, Yokohama (JP)

(73) Assignee: JVC KENWOOD CORPORATION, Yokohama-Shi, Kanagawa (JP)

( * ) Notice: Subject to any disclaimer, the term of this patent is extended or adjusted under 35 U.S.C. 154(b) by 0 days. days.

(21) Appl. No.: 15/214,007

(22) Filed: Jul. 19, 2016

(65) Prior Publication Data

US 2017/0026739 A1 Jan. 26, 2017

(30) Foreign Application Priority Data

Jul. 24, 2015 (JP) ..... 2015-146805

(51) Int. Cl.

| | |
|---|---|
| ***H04R 1/28*** | (2006.01) |
| *H04R 1/10* | (2006.01) |
| *H04R 1/34* | (2006.01) |
| *H04R 5/033* | (2006.01) |

(52) U.S. Cl.

CPC ..... *H04R 1/2857* (2013.01); *H04R 1/1008* (2013.01); *H04R 1/1066* (2013.01); *H04R 1/2861* (2013.01); *H04R 1/2869* (2013.01); *H04R 1/2873* (2013.01); *H04R 1/345* (2013.01); *H04R 5/033* (2013.01)

(58) Field of Classification Search

CPC .... H04R 1/2823; H04R 1/1066; H04R 1/323; H04R 1/28; H04R 1/30; H04R 1/32; H04R 1/10; H04R 9/02; H04R 2205/024; H04R 2201/103; H04R 2205/022; H04R 2420/07; H04R 1/46; H04R 2460/13; H04R 25/606; H04R 5/033; H04R 5/027; H04R 5/0335

See application file for complete search history.

(56) References Cited

U.S. PATENT DOCUMENTS

| | | | | | |
|---|---|---|---|---|---|
| 2,295,483 | A | * | 9/1942 | Knowles | H04R 1/22 181/148 |
| 3,327,808 | A | * | 6/1967 | Shaper | H04R 1/2857 181/153 |
| 4,168,761 | A | * | 9/1979 | Pappanikolaou | H04R 1/2857 181/152 |
| 4,298,087 | A | * | 11/1981 | Launay | H04R 1/345 181/153 |
| 5,832,099 | A | * | 11/1998 | Wiener | H04R 1/2888 181/144 |

(Continued)

FOREIGN PATENT DOCUMENTS

| | | | | |
|---|---|---|---|---|
| JP | 2012-80219 | * | 4/2012 | H04R 1/10 |
| JP | 2012-80219 | A | 4/2012 | |
| JP | 2012080219 | * | 4/2012 | H04R 1/10 |

*Primary Examiner* — Davetta W. Goins
*Assistant Examiner* — Oyesola C Ojo
(74) *Attorney, Agent, or Firm* — Nath, Goldberg & Meyer; Jerald L. Meyer; Stanley N. Protigal

(57) ABSTRACT

A speaker includes: an open-backed speaker unit, a housing, and a fin unit. The housing is disposed so as to cover a rear side of the speaker unit, and forms a back cavity with the speaker unit. The fin unit is disposed in the back cavity, and includes an annular or arc-like fin, which approaches a rear side of the housing as going from a center of the speaker unit toward an outer diameter side thereof, and expands in diameter as separating from the speaker unit.

5 Claims, 11 Drawing Sheets

(56) References Cited

U.S. PATENT DOCUMENTS

| | | | | |
|---|---|---|---|---|
| 6,634,455 | B1 * | 10/2003 | Yang | H04R 1/2857 181/155 |
| 7,436,972 | B2 * | 10/2008 | Bouvier | H04R 1/345 381/338 |
| 8,479,874 | B2 * | 7/2013 | Moreton Cesteros | H04R 1/02 181/148 |
| 8,925,676 | B2 * | 1/2015 | Murray | A47B 81/06 181/153 |
| 2005/0254681 | A1 * | 11/2005 | Bailey | H04R 1/2811 381/396 |
| 2009/0173567 | A1 * | 7/2009 | Stiles | H04R 1/2826 181/148 |
| 2013/0004008 | A1 * | 1/2013 | Kuo | H04R 1/2834 381/349 |
| 2015/0078605 | A1 * | 3/2015 | Yang | H04R 1/2888 381/353 |

* cited by examiner

SPEAKER AND HEADPHONE DEVICE

CROSS REFERENCE TO RELATED APPLICATION

This application is based upon and claims the benefit of priority under 35 U.S.C. § 119 from Japanese Patent Application No. 2015-146805, filed on Jul. 24, 2015, the entire contents of which are incorporated herein by reference.

BACKGROUND

The present disclosure relates to a speaker and a headphone device, each of which uses open-backed speaker units.

In a speaker composed by including a speaker unit and an enclosure, open-backed ones are sometimes used for the speaker units.

Moreover, for speaker units used in a so-called overhead-type headphone device that include a headband, the open-backed ones are frequently used. The open-backed speaker unit has an opening on the back (the outside, for example) surface of a case of the speaker unit, and emits a sound not only from the front (the inside, for example) surface, but also from the back surface.

An overhead-type headphone device including the open-backed speaker units is described in Japanese Unexamined Patent Application Publication No. 2012-080219.

SUMMARY

Usually, it is empirically known that in a speaker (speaker system) including the open-backed speaker unit and the enclosure to which the speaker unit is attached, a reproduction volume in the bass range is increased as the depth of the enclosure is longer.

In the overhead-type headphone device, back covers of housing portions which house the speaker units and are put on the ears correspond to the enclosures, and the housing portions correspond to the speakers.

Accordingly, it is examined to achieve an increase of the production volume of the bass range, by elongating the depth of the housing portions; however, it is difficult to form the housing portions in the headphone device into a shape with a long depth from the viewpoint of design and enhancement of fitting property to the ears.

Therefore, in such a speaker or a headphone device, each of which has a short depth, it is desired to make an idea to increase the production volume of the bass range without elongating the depth of the enclosures or the back covers.

A first aspect of the embodiments provides a speaker including: an open-backed speaker unit; a housing which is disposed so as to cover a rear side of the speaker unit, and forms a back cavity with the speaker unit; and a fin unit, which is disposed in the back cavity, and includes an annular or arc-like first fin expanding in diameter, so as to approach a rear side of the housing as going from a center of the speaker unit toward an outer diameter side of the speaker unit.

A second aspect of the embodiments provides a headphone device including: a pair of the speakers according to the above-mentioned configuration; and a headband that couples the pair of speakers to each other.

DETAILED DESCRIPTION

By using FIG. 1 to FIG. 11, a description is made of a headphone device according to the embodiments by a headphone device 51 as a preferred example.

Figure 1:
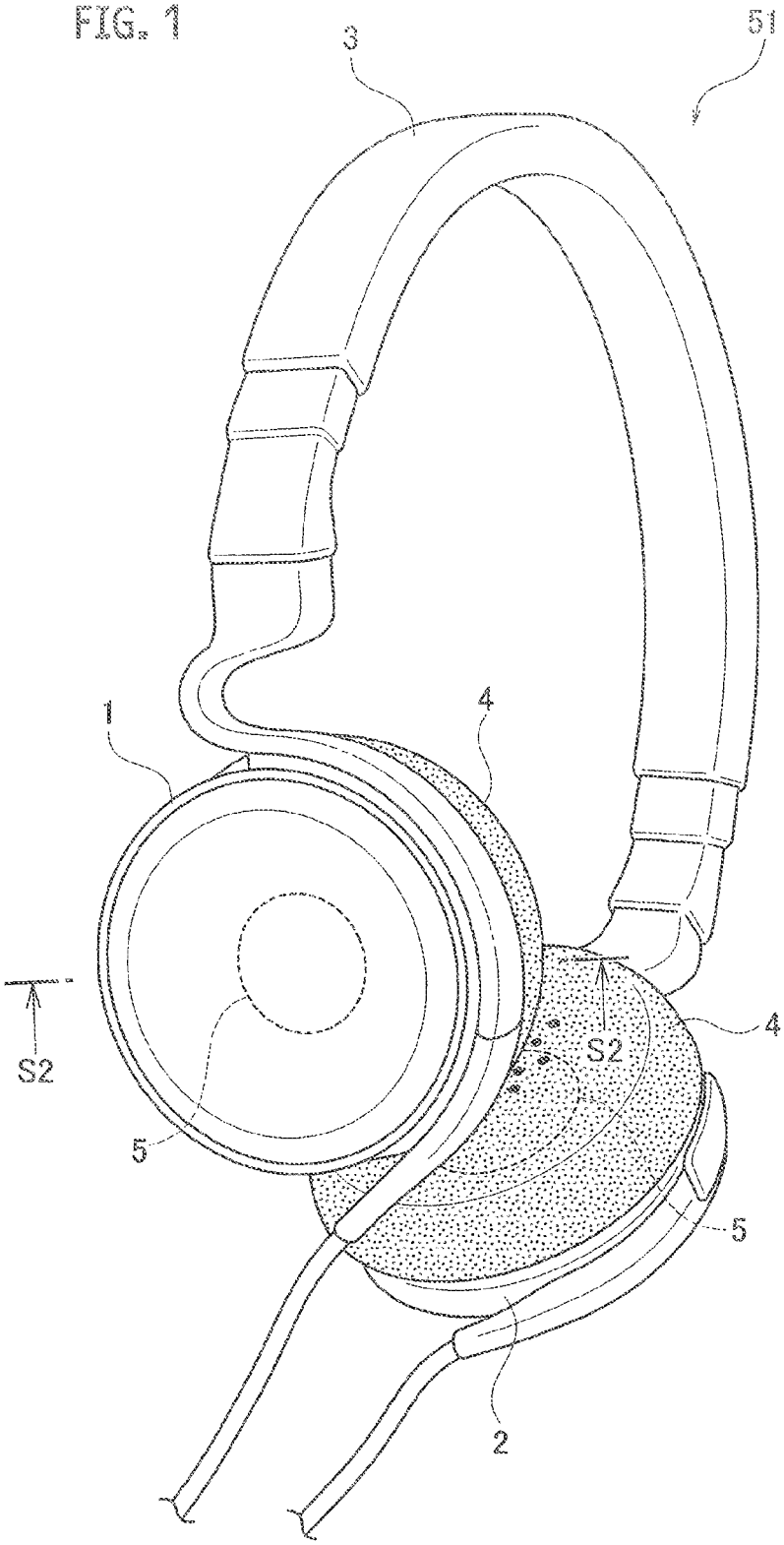
FIG. 1 is a perspective view illustrating an overall configuration of a headphone device 51 as an example of a headphone device according to at least one embodiment.

FIG. 1 is an exterior perspective view showing the headphone device 51. The headphone device 51 is of an overhead type, and includes: a housing 1 put on the left ear when used; a housing 2 put on the right ear when used; and a curved headband 3 that couples the housing 1 and the housing 2 to each other.

Each of the housings 1 and 2 is formed into a columnar shape that is approximately flat, and a soft ear pad 4 is attached to each thereof, so as to be freely detachable. In the inside of each of the housings 1 and 2, a speaker unit 5 is housed. The shape of the housing 1 and the shape of the housing 2 are the same, and accordingly, a specific description is made below of the shape of the housing 1.

Figure 2:
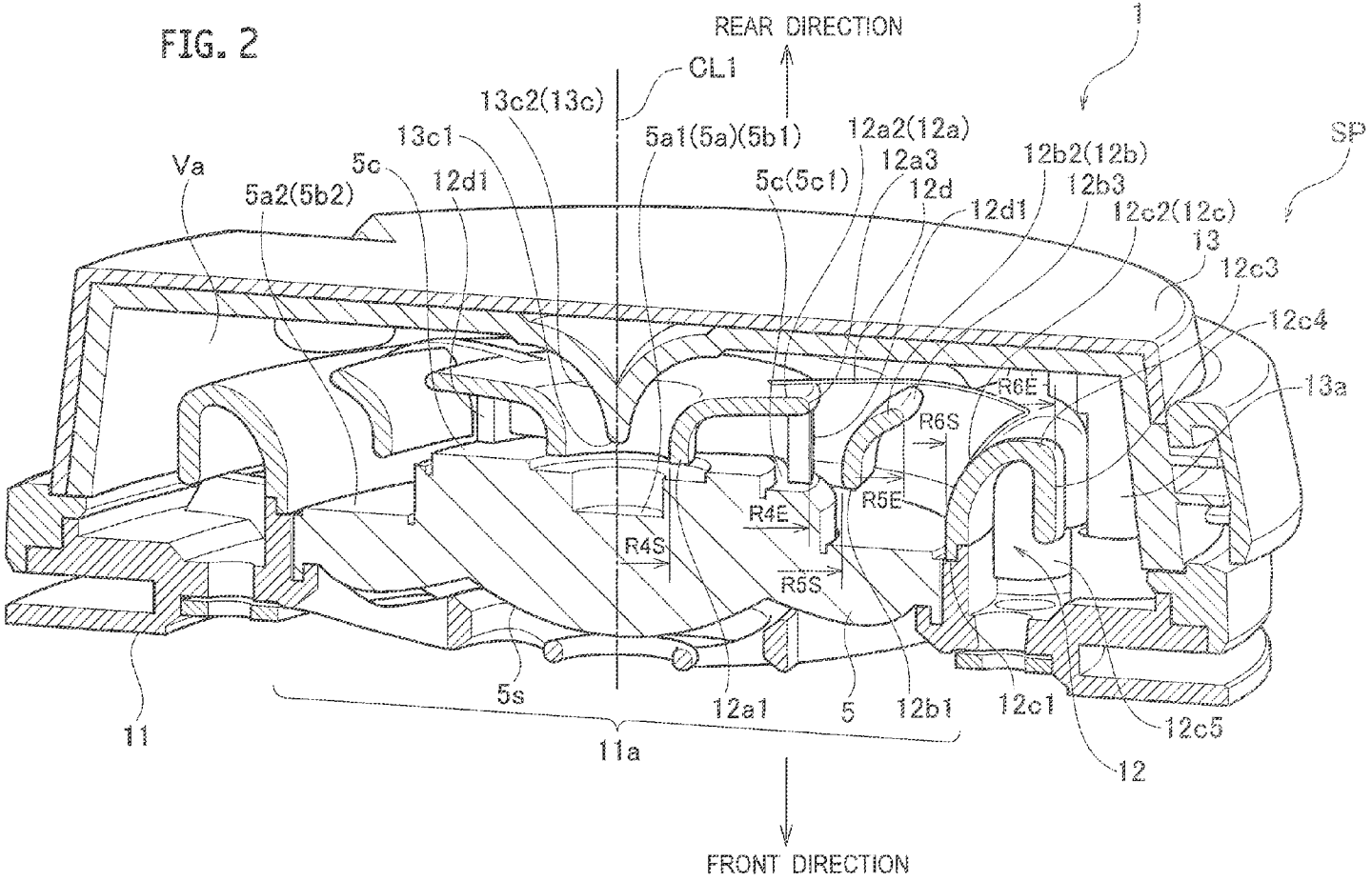
FIG. 2 is a perspective cross-sectional view illustrating a housing 1 in the headphone device 51.
Figure 3:
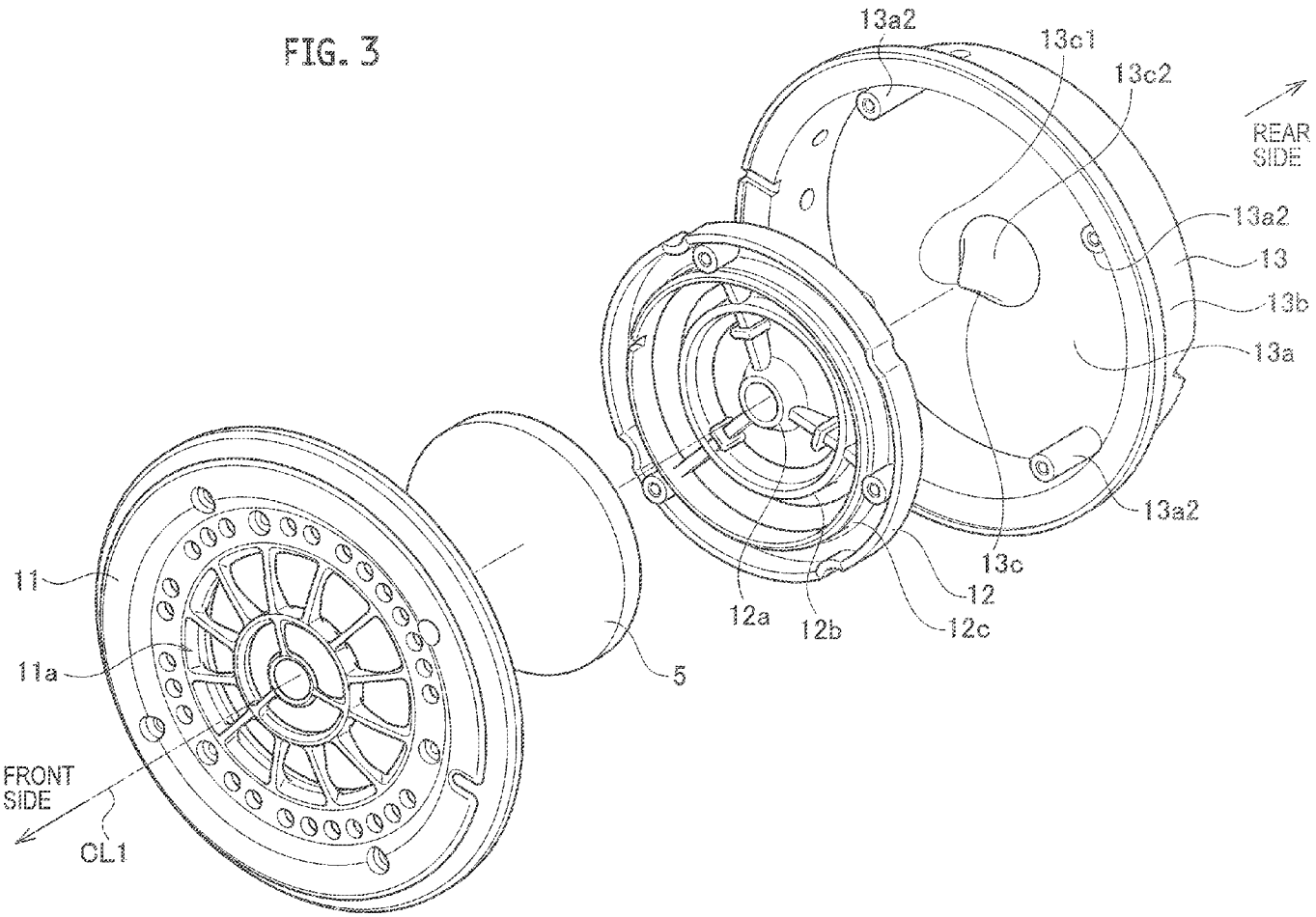
FIG. 3 is a perspective assembly view illustrating the housing 1.

FIG. 2 is a perspective cross-sectional view of the housing 1 in FIG. 1, which is taken along an S2-S2 position. FIG. 2 shows a speaker SP. FIG. 3 is a perspective assembly view of the housing 1. In FIG. 2 and FIG. 3, the ear pad 4 is not shown. Moreover, in the following description, a front direction and a rear direction are determined, as shown in FIG. 2. When the headphone device 51 is being used, the ear is located on the side in the front direction, and the rear direction is the direction apart from a head.

As shown in FIG. 2 and FIG. 3, the housing 1 has a baffle plate 11 on the side thereof serving as the front direction. The baffle plate 11 is formed into a disc shape, and the center portion thereof is formed as a sound-emitting portion 11*a*, which has a radial grid shape that allows air to flow through.

In an attitude where the baffle plate 11 side is front, the speaker unit 5 is disposed on the rear side (the side in the rear direction) of the sound-emitting portion 11*a* in the baffle plate 11. In FIG. 3, the speaker unit 5 is illustrated schematically in a disc shape.

The housing 1 includes: a fin unit 12 which is disposed on the side of the speaker unit 5 in the rear direction and is fixed to the baffle plate 11 by a screw, while sandwiching the speaker unit 5 therebetween; and a flat, pan-like back cover 13 that is fixed to the baffle plate 11 by the screw, so as to cover the speaker unit 5 and the fin unit 12.

By being surrounded by the baffle plate 11 and the back cover 13, a space is formed, which substantially becomes the back cavity Va (refer to FIG. 2), and is hermetically sealed on the side of the speaker unit 5 in the rear direction. Hereinafter, the back cavity Va is referred to as the space Va.

As shown in FIG. 2, the speaker unit 5 includes: a case 5*c*; and a diaphragm 5*s* supported on the case 5*c* on a side thereof in the front direction.

The speaker unit 5, the fin unit 12, and the back cover 13 are formed to have an approximately circular contour when viewed from above, and are assembled to one another while taking individual central axes thereof as a common central axis CL1.

Figure 4:
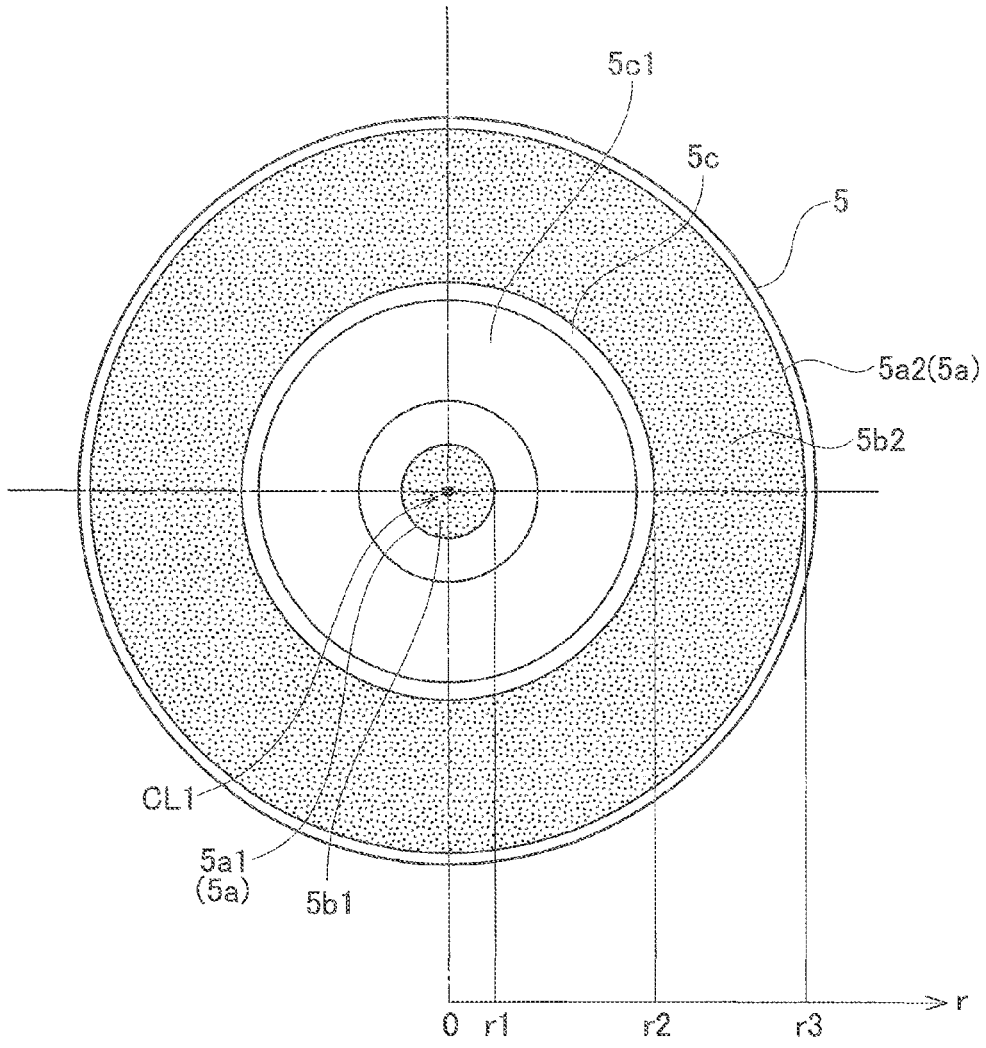
FIG. 4 is a rear view of a speaker unit 5 housed in the housing 1.

Next, a description is made of the speaker unit 5, also with reference to FIG. 4. FIG. 4 is a rear view of the speaker unit 5. The speaker unit 5 is of an open-backed type exhibiting a flat disc shape. Hence, at a time when a voice is outputted, a sound generated by vibrations of the diaphragm 5*s* is emitted not only from the front, but also from the rear sound-emitting portion 5*a* on the rear. The case 5*c* of the speaker unit 5 includes a sound-emitting hole (not shown) on the side serving as the front direction, and includes the rear sound-emitting portion 5*a* as an opening also on a side serving as the rear direction.

Specifically, the speaker unit 5 includes, as the rear sound-emitting portion 5*a*: a central sound-emitting portion 5*a*1 provided as a circular range, with a radius r1 about a position of the central axis CL1 taken as a center; and an annular sound-emitting portion 5*a*2 provided as an annular range between a radius r2 and a radius r3. In this example, the inner edge and the outer edge of the annular sound-emitting portion 5*a*2 are individually circular, and are similar to each other.

Onto the central sound-emitting portion 5*a*1 and the annular sound-emitting portion 5*a*2, an acoustic filter 5*b*1 and an acoustic filter 5*b*2, which are individually formed of foamed resin sheets or the like, are attached, respectively.

Figure 5:
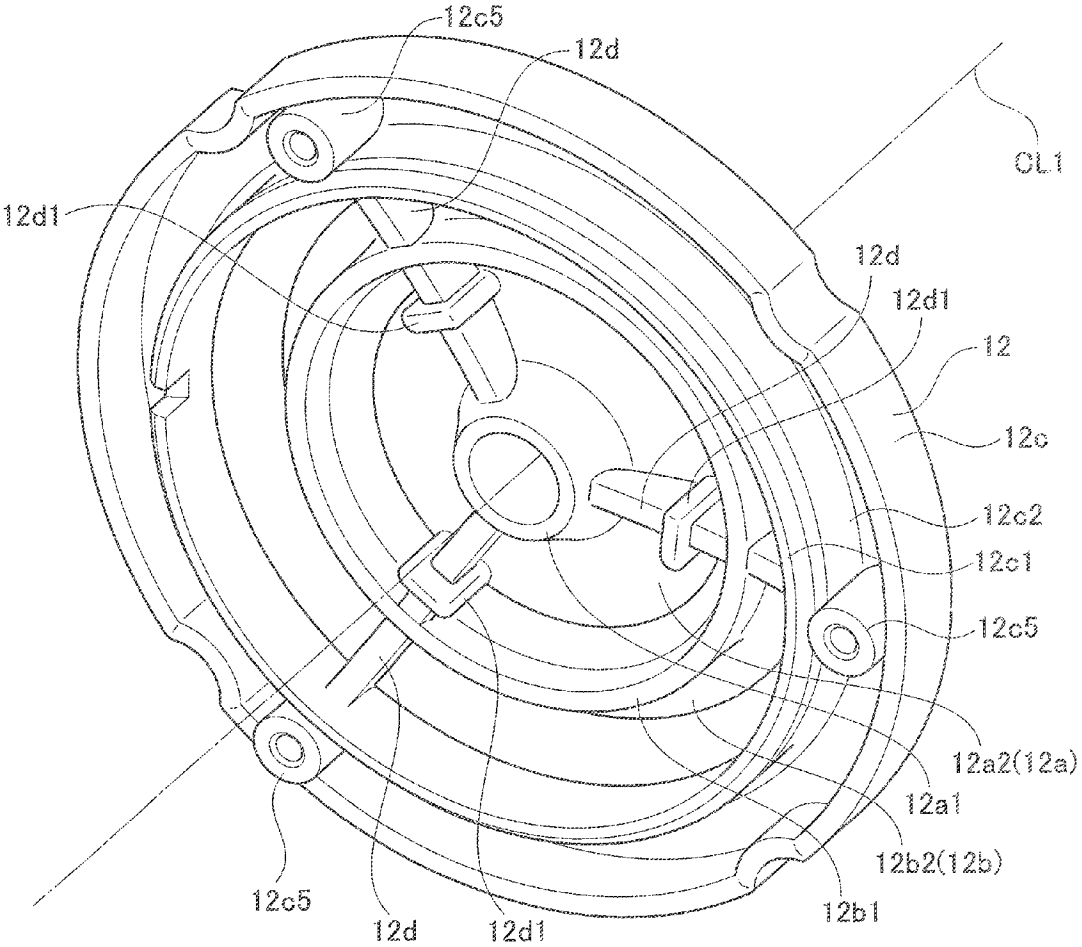
FIG. 5 is a perspective view illustrating a fin unit 12 provided in the housing 1.
Figure 6:
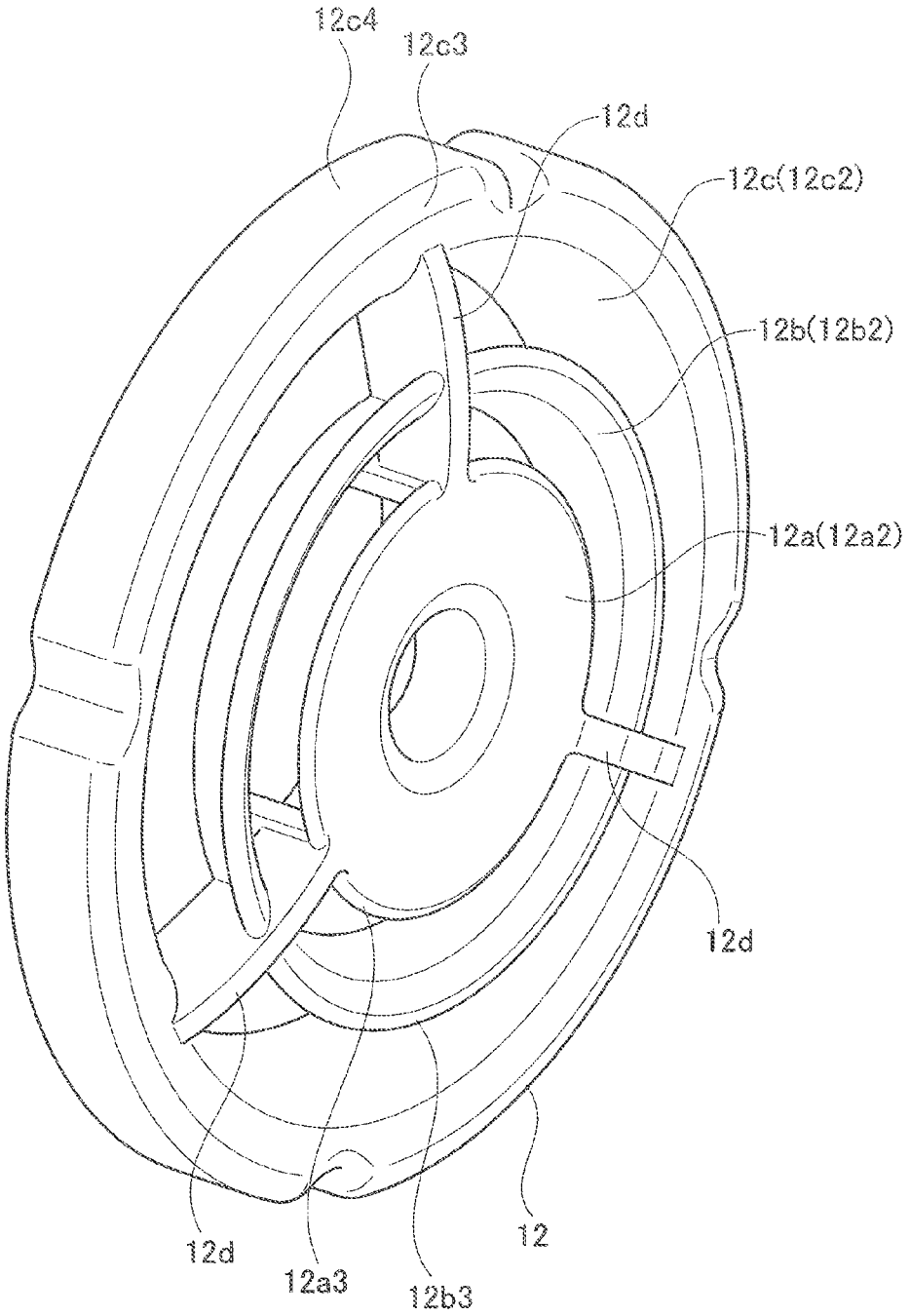
FIG. 6 is a perspective view of a fin unit 12 when viewed from a side in a rear direction.
Figure 7:
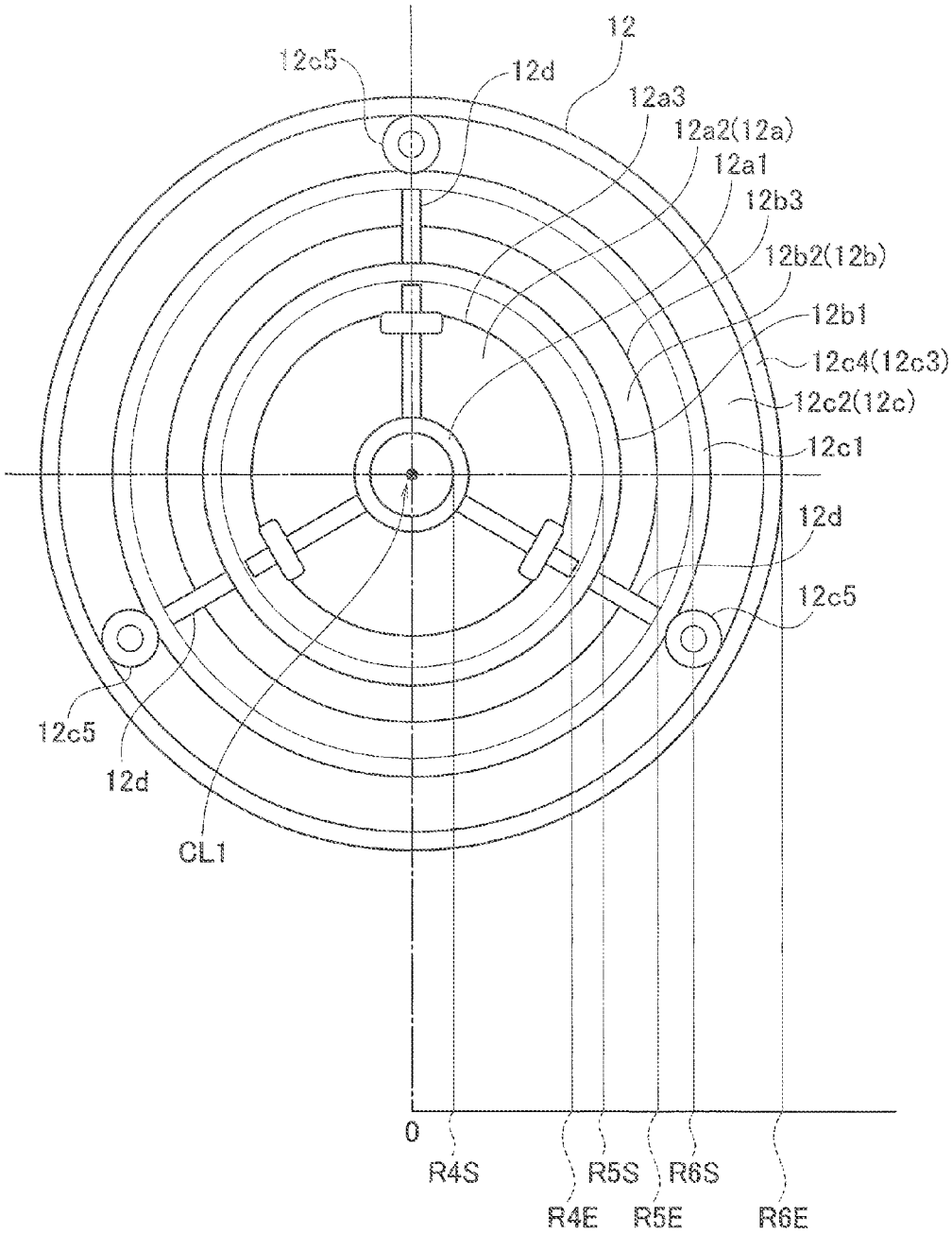
FIG. 7 is a front view illustrating the fin unit 12.

Next, a description is made of the fin unit 12, mainly with reference to FIG. 5 through FIG. 7. FIG. 5 is an enlarged view of the fin unit 12 shown by the perspective view in FIG. 3. FIG. 6 is a perspective view of the fin unit 12, when viewed from the side in the rear direction. FIG. 7 is a frontal view of the fin unit 12.

While taking the central axis CL1 as a center, the fin unit 12 is formed of resin by including: three annular fins 12*a*, 12*b*, and 12*c*, which are concentric with one another, but are different from one another in diameter; and three radial support beams 12*d*, which couple the fins 12*a* through 12*c* to one another.

As shown in FIG. 2 and FIG. 5, in the respective support beams 12*d*, the ribs 12*d*1 are formed, which extend in a circumferential direction and protrude in the front direction.

The three fins 12*a* to 12*c* are formed into annular or arcuate shapes by including diameter-expanded portions 12*a*2 to 12*c*2, which are set to have minimum diameters on side-end portions 12*a*1 to 12*c*1 in the front direction, and expand in diameter as going in the rear direction. Here, a description is made of trumpet-like ones, which are formed into annular shapes and extend toward the rear direction. The fins 12*a* to 12*c* are formed into arcuate shapes in the case where the fins 12*a* to 12*c* cannot be formed into the annular shapes, or wiring portions overlap annular portions since terminals and the like are provided in the inside of the housing 1.

A specific description is made of the shapes of the fins 12*a* to 12*c*, mainly with reference to FIG. 2 and FIG. 7. In the fin 12*a*, an in radius of a front-side end portion 12*a*1 thereof is defined as R4S, and the fin 12*a* has such an annular diameter-expanded portion 12*a*2, which gradually expands in diameter as going from the front-side end portion 12*a*1 toward the rear direction, and reaches the rear-side end portion 12*a*3 with the radius R4E. The fin 12*a* approaches the rear side of the housing 1 (back cover 13) as going from the center of the speaker unit 5 toward the outer diameter side thereof.

In the fin 12*b*, an in radius of a front-side end portion 12*b*1 thereof is defined as R5S larger than a radius R4E, and the fin 12*b* has such an annular diameter-expanded portion 12*b*2, which gradually expands in diameter as going toward the rear direction, and reaches a rear-side end portion 12*b*3 with a radius R5E. The fin 12*b* approaches the rear side of the housing 1 as going from the center of the speaker unit 5 toward the outer diameter side thereof.

In the fin 12*c*, an in radius of the front-side end portion 12*c*1 thereof is defined as R6S larger than the radius R5E, and the fin 12*c* has such an annular diameter-expanded portion 12*c*2, which gradually expands in diameter as going toward the rear direction, and reaches the rear-side end portion 12*c*3 with the radius R6E. The fin 12*c* approaches the rear side of the housing 1 as going from the center of the speaker unit 5 toward the outer diameter side thereof.

Moreover, the fin 12*c* has a return fin portion 12*c*4, which is connected to the rear-side end portion 12*c*3, extends in the front direction into an annular shape with a radius R6E that is approximately the same radius, and serves for elongating the propagation distance of the sound emitted from the rear sound-emitting portion 5*a*.

The fin 12*c* has three bosses 12*c*5, which extend in the front direction and separate from one another in the circumferential direction at positions corresponding to the support beams 12*d* on the side serving as the front direction of the diameter-expanded portion 12*c*2. Pilot holes are formed in the bosses 12*c*5, and the baffle plate 11 is tightened and fixed to the bosses 12*c*5 by tapping screws (not shown) from the side in the front direction.

In this tightened and fixed state, the ribs 12*d*1, which are individually provided on the three support beams 12*d*, abut against unopened portions 5*c* 1 with a radius r1 to a radius r2 (refer to FIG. 4) in the case 5*c* of the speaker unit 5. In such a way, the speaker unit 5 is held between the baffle plate 11 and the fin unit 12, without a gap in the front/rear direction.

Next, a description is made of the back cover 13. As shown in FIG. 3, the back cover 13 is formed of resin by including a disc-like bottom wall 13*a* and a side wall 13*b*, erected annularly from the circumference of the bottom wall 13*a*.

On positions of the bottom wall 13*a* which are close to the side wall 13*b*, four bosses 13*a*2 are erected apart from one another in the circumferential direction. Pilot holes are formed in the bosses 13*a*2, and the baffle plate 11 is tightened and fixed to the bosses 13*a*2 by tapping screws (not shown) from the side in the front direction.

By such tightening and fixing, the space Va, surrounded by the baffle plate 11, the speaker unit 5, and the back cover 13 is substantially formed as the back cavity in a hermetically sealed state.

On the bottom wall 13*a*, a conic protruding portion 13*c* is formed, which has an apex 13*c*1 on the central axis CL1. An inclined circumferential surface 13*c*2 of the protruding portion 13*c* is formed to be a recessed surface on a radial cross section.

Figure 8:
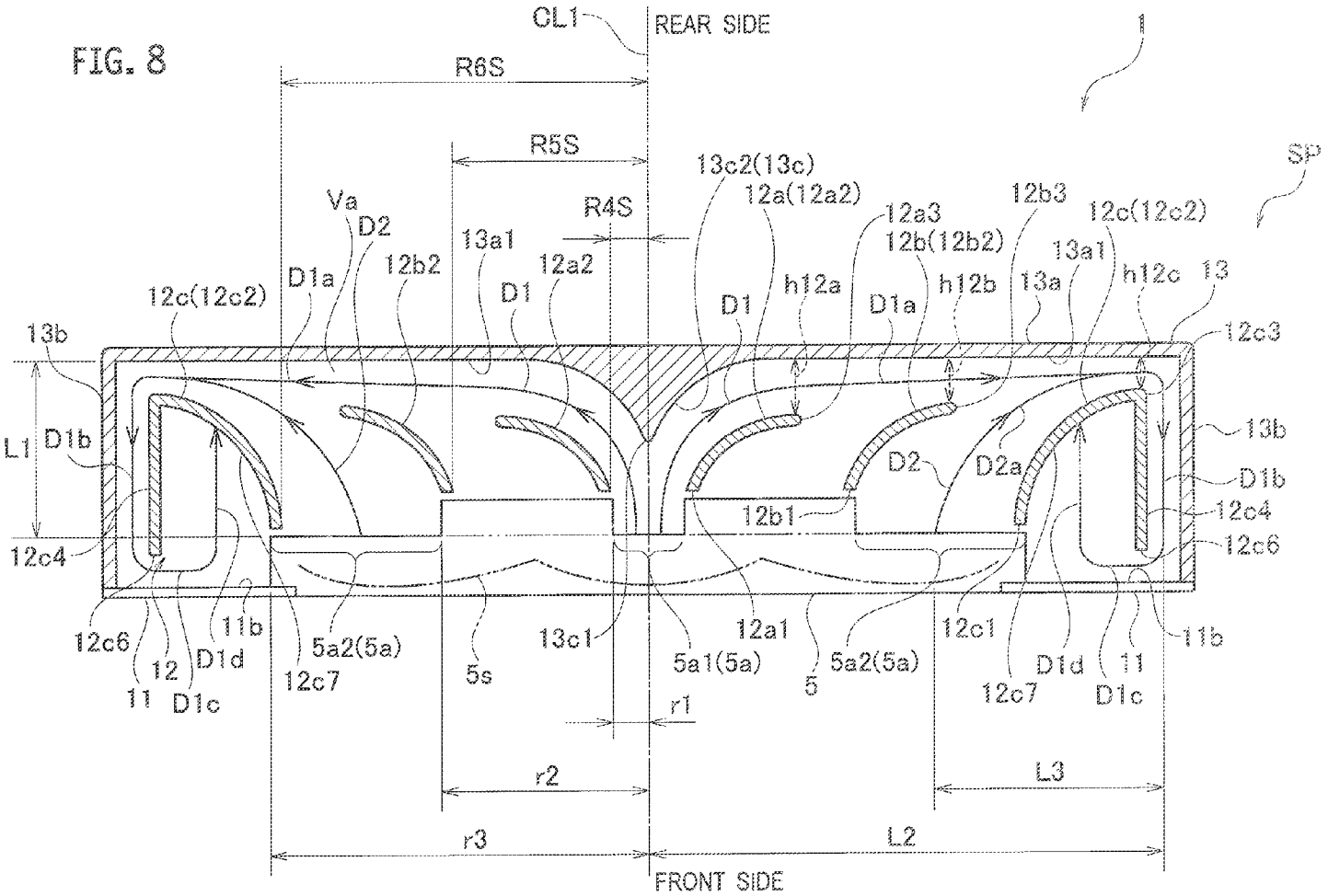
FIG. 8 is a schematic cross-sectional view of the housing 1.

FIG. 8 is a schematic cross-sectional view for explaining a positional relationship in the housing 1 between the rear sound-emitting portion 5*a* of the speaker unit 5 and the fins 12*a* to 12*c* of the fin unit 12 in the diameter direction and the front/rear direction. FIG. 8 illustrates the perspective cross-sectional shape of FIG. 2 into a schematic planar shape.

In FIG. 8, both of the central sound-emitting portion 5*a*1 and the annular sound-emitting portion 5*a*2 are located at the same position in the front/rear direction, and the distance in the front/rear direction between this position and the inner surface 13*a*1 of the bottom wall 13*a* is defined as distance L1.

As shown in FIG. 8, the front-side end portion 12*a*1 of the annular fin 12*a* is located at a position approximately corresponding to an outer circumferential edge of the central sound-emitting portion 5*a*1 of the speaker unit 5. That is, the radius r1 and the radius R4S are values relatively approximate to each other. For example, it is recommended that the radius R4S may stay within the range of ±5% of the radius r1.

The front-side end portion 12*b*1 of the annular fin 12*b* is located at a position approximately corresponding to an inner circumferential edge of the annular sound-emitting portion 5*a*2 of the speaker unit 5. That is, the radius r2 and the radius R5S are values relatively approximate to each other. For example, it is recommended that the radius R5S may stay within the range of ±10% of the radius r2.

The front-side end portion 12*c*1 of the annular fin 12*c* is located at a position approximately corresponding to an outer circumferential edge of the annular sound-emitting portion 5*a*2 of the speaker unit 5. That is, the radius r3 and the radius R6S are values relatively approximate to each other. For example, it is recommended that the radius R6S may stay within the range of ±15% of the radius r3.

The fin 12*a* is smaller in diameter than the fin 12*b* and the fin 12*c*, and is located inside of the fin 12*b* and the fin 12*c*, and accordingly, the fin 12*a* is an inner fin with respect to the fin 12*b* and the fin 12*c*. In a similar way, the fin 12*b* is an inner fin with respect to the fin 12*c*.

If the fin 12*c* is the first fin, then the fin 12*b* or the fin 12*a* is the second fin that is the inner fin. If the fin 12*b* is the first fin, then the fin 12*a* is the second fin that is the inner fin. The fin unit 12 needs only to include at least one fin. In a case where the fin unit 12 includes the first fin and the second fin, there needs to be only one second fin.

The fins 12*a* to 12*c* are provided to separate from the case 5*c* of the speaker unit 5 in the rear direction, so as to make a gap with the case 5*c* without contacting the case 5*c*. In such a way, at an output time of the speaker unit 5, contact noise between the case 5*c* and the fins 12*a* to 12*c* is not generated.

The apex 13*c*1 of the protruding portion 13*c* of the back cover 13 is located between the front-side end portion 12*a*1 and the rear-side end portion 12*a*3 of the fin 12*a* in the front/rear direction.

The housing 1 is configured so that, by the above-mentioned configuration including the fin unit 12 and the protruding portion 13*c*, the sound emitted from the rear sound-emitting portion 5*a* into the space Va can propagate for a long distance, in comparison with the case where the fin unit 12 and the protruding portion 13*c* are not present (like a conventional housing).

Moreover, the fin unit 12 is disposed as a partition wall between the rear sound-emitting portion 5*a* and the inner surface 13*a*1 of the back cover 13. Hence, by the fact that the fin unit 12 is provided, a so-called return sound is reduced, which is emitted from the rear sound-emitting portion 5*a*, is reflected on the inner surface 13*a*1, and returns to the rear sound-emitting portion 5*a*.

Figure 9:
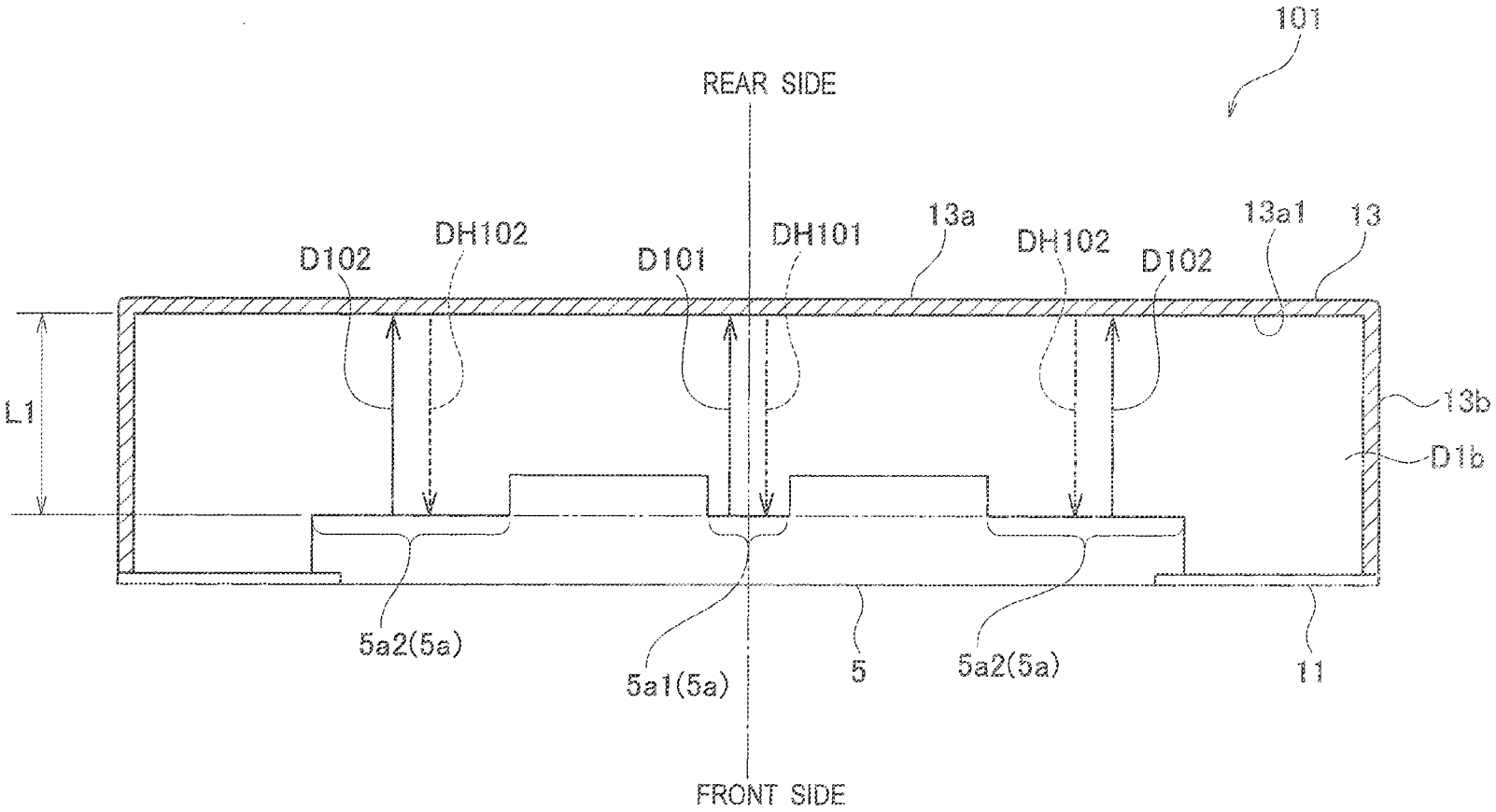
FIG. 9 is a cross-sectional view illustrating a housing 101 as a comparative example, which does not include the fin unit 12.

FIG. 9 is a cross-sectional view showing a housing 101 as a comparative example, in which the fin unit 12 and the protruding portion 13*c* are deleted from the housing 1. Specifically, FIG. 9 is a view explaining a propagation mode example of the sound when an impulse signal is inputted to the speaker unit 5.

In the housing 101, upon propagating by a distance L1 in the rear direction, a central emission sound D101 and an annular emission sound D102, which are emitted in the rear direction from the central sound-emitting portion 5*a*1 and the annular sound-emitting portion 5*a*2, reach the inner surface 13*a*1 of the bottom wall 13*a* serving as a barrier.

Then, the central emission sound D101 and the annular emission sound D102 are reflected on the inner surface 13*a*1, and return as reflected sounds DH101 and DH102 to the central sound-emitting portion 5*a*1 and the annular sound-emitting portion 5*a*2.

As described above, in the housing 101, propagation distances of the central emission sound D101 and the annular emission sound D102 become the distance L1.

In contrast, in the housing 1 shown in FIG. 8, a central emission sound D1, which is emitted from the central sound-emitting portion 5*a*1 in the rear direction, passes through a path between the diameter-expanded portion 12*a*2 of the fin 12*a* and the inclined circumferential surface 13*c*2 of the protruding portion 13*c*, travels in the rear direction by being guided by these, and in addition, propagates outward in the diameter direction thereby. By the fact that the protruding portion 13*c* is disposed, the propagation of the sound is accelerated, which is made outward in the diameter direction. Even when the protruding portion 13*c* is not disposed, the central emission sound D1, which is emitted from the central sound-emitting portion 5*a*1 in the rear direction, propagates outward in the diameter direction.

Then, the central emission sound D1 propagates outward in the diameter direction, along the inner surface 13*a*1 of the bottom wall 13*a* (arrow-indicated path D1*a*). Subsequently, the central emission sound D1 propagates toward the front between the side wall 13*b* and the return fin portion 12*c*4 (arrow-indicated by D1*b*). After this, the central emission sound D1 propagates toward the central axis CL1 between a front-side end portion 12*c*6 of the return fin portion 12*c*4 and the rear 11*b* of the baffle plate 11 (arrow-indicated path D1*c*), and thereafter, reaches a surface 12*c*7 on the frontal side of the diameter-expanded portion 12*c*2 of the fin 12*c* (arrow-indicated arrow D1*d*).

That is, the propagation path of the central emission sound D1 becomes a path shown by the arrow-indicated path D1*a* to the arrow-indicated path D1*d*, and the propagation distance thereof becomes approximately the distance obtained by adding two times and a half the distance L1 and the distance L2 to each other. The distance L2 is the distance from the central axis CL1 to a midpoint between the side wall 13*b* and the return fin portion 12*c*4.

Meanwhile, the annular emission sound D2, which is emitted from, the annular sound-emitting portion 5*a*2 in the rear direction, passes between the diameter-expanded portion 12*b*2 of the fin 12*b* and the diameter-expanded portion 12*c*2 of the fin 12*c*, travels in the rear direction by being guided by these, and in addition, propagates outward in the diameter direction thereby. Then, the annular emission sound D2 reaches the surface 12*c*7 on the frontal side of the diameter-expanded portion 12*c*2 of the fin 12*c*, through a propagation path similar to that of the central emission sound D1, through such a path shown by the path arrows D1*b* to D1*d*.

That is, the propagation path of the annular emission sound D2 becomes such a path shown by the path arrow D2*a* and the path arrows D1*b* to D1*d*, and the propagation distance thereof becomes approximately a distance obtained by adding two times and a half the distance L1 and the distance L3 to each other. The distance L3 is the distance between such a radial center position of the annular sound-emitting portion 5*a*2, and the maximum-diameter position of the distance L2.

As described above, the housing 1 includes the fin unit 12, whereby, even when the depth of the housing 1 is equal to the depth of the housing 101, propagation path lengths (propagation distances) of the central emission sound D1 and the annular emission sound D2 in the housing 1 are remarkably long. As described above, such a configuration in which the propagation path of the central emission sound D1 and the propagation path of the annular emission sound D2 join together is adopted, whereby it becomes easy for the sounds emitted from the sound-emitting portions 5*a*1 and 5*a*2 to reach path ends farthest from the sound-emitting portions 5*a*1 and 5*a*2 of the propagation paths.

Figure 10:
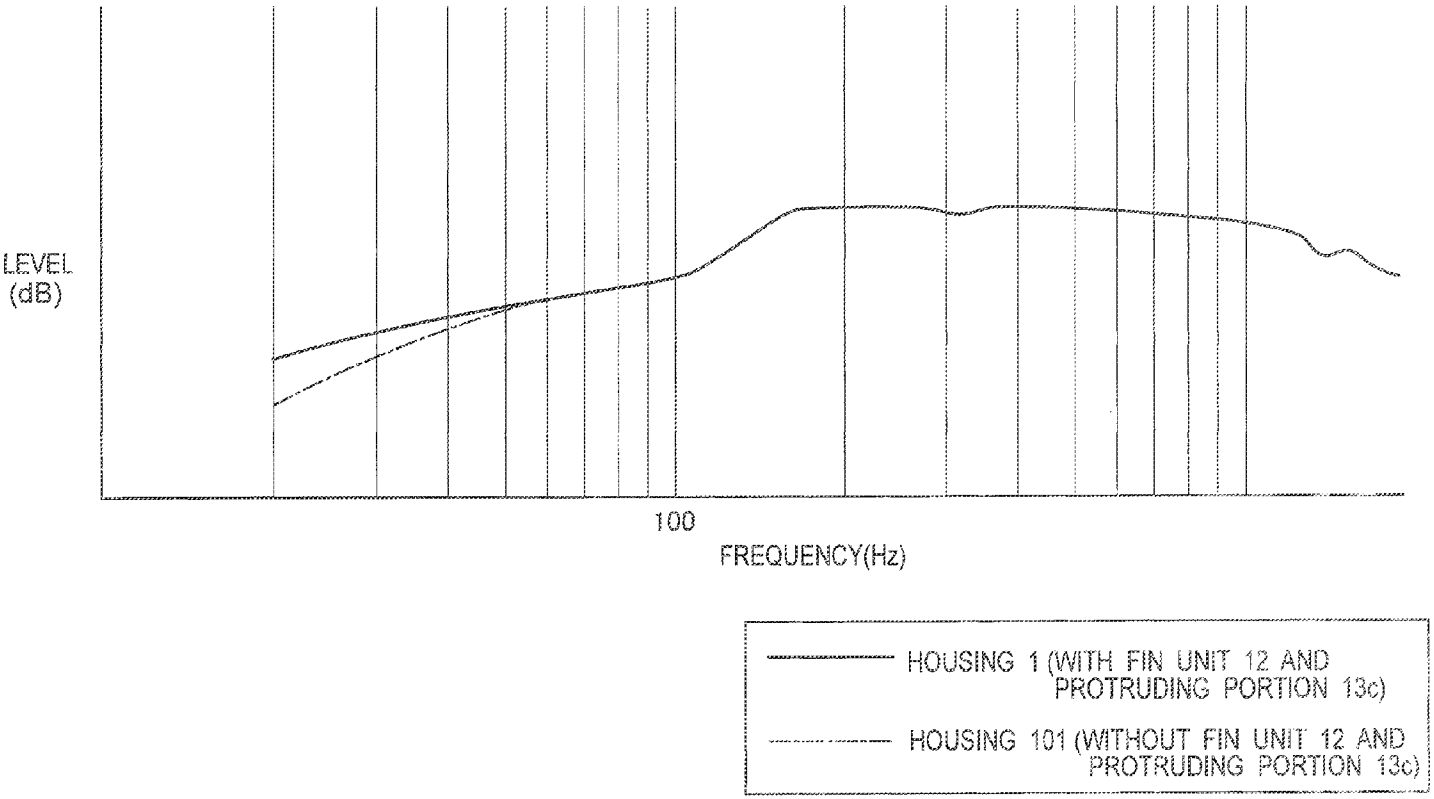
FIG. 10 is a graph illustrating sound pressure frequency characteristics of the housing 1 and the housing 101.

FIG. 10 is a graph illustrating sound pressure frequency characteristics of a sound reproduced by the housing 1 and a sound reproduced by the housing 101 for comparing with each other. A solid line indicates the characteristics of the sound reproduced by the housing 1, and an alternating long and short dash line indicates the characteristics of the sound reproduced by the housing 101.

FIG. 10 shows two characteristics between which there is a difference as to whether or not the fin unit 12 and the protruding portion 13*c* are present. It is understood that the reproduced sound of the housing 1 including the fin unit 12 and the protruding portion 13*c* has a higher sound pressure in the bass range, and increases the volume thereof.

As described above in detail, in comparison with the housing 101 that does not include the fin unit 12 and the protruding portion 13*c* in contrast to the housing 1, in the housing 1, the propagation distance of the sound emitted from the rear sound-emitting portion 5*a* is longer, though the distance L1 in the front/rear direction of the space Va is the same. It is confirmed that a measured value of the sound pressure in the bass range gets higher.

In the headphone device 51 including the housing 1, a reproduction volume in the bass range is increased without elongating the depth of the housing 1.

The reflected sound DH101, which is generated in the housing 101 and returns to the central sound-emitting portion 5*a*1, is not generated in the housing 1 since the protruding portion 13*c* is provided therein. Hence, the reflected sound that returns to the central sound-emitting portion 5*a*1 does not affect the vibrations of the diaphragm. 5*s*, and distortion of the reproduced sound by the housing 1 is small.

Moreover, in the housing 1, a major part of the reflected sound, which is emitted from the annular sound-emitting portion 5*a*2 in the rear direction, is blocked by the fin 12*b* as it reaches the inner surface 13*a*1 of the bottom wall 13*a* and is reflected thereon. Accordingly, the reflected sound that returns to the annular sound-emitting portion 5*a*2 becomes slight. Hence, an influence of the reflected sound of the annular emission sound D2, which is emitted from the annular sound-emitting portion 5*a*2 to the vibrations of the diaphragm 5*s* is slight, and the reproduced sound by the housing 1 also has a little distortion in this case.

In the housing 1, the shapes of the fins 12*a* to 12*c*, and the protruding portion 13*c* of the bottom wall 13*a* are determined so that a cross-sectional area (cross-sectional area in a direction perpendicular to the propagation direction) of the propagation path of the sound emitted from the annular sound-emitting portion 5*a*2 is constant.

For example, in FIG. 8, the central emission sound D1, emitted from the central sound-emitting portion 5*a*1, is guided by the diameter-expanded portion 12*a*2 of the fin 12*a* and the inclined circumferential surface 13*c*2 of the protruding portion 13*c*, and propagates outward in the diameter direction as propagating in the rear direction.

As shown in FIG. 6 and the like, the fin 12*a* is formed into an annular shape, and accordingly, the central emission sound D1 propagates around the entire circumference within 360° so as to expand in diameter. Hence, if the cross-sectional area in a unit angle range of the propagation path is constant, then a total cross section of the propagation path expands as the central emission sound D1 is propagating.

It is empirically known that sound quality tends to decrease if the cross-sectional area in the direction perpendicular to the propagation direction, the cross-sectional area being of the propagation path, is changed to a large extent in such an event where the emission sound propagates in the space Va that is the back cavity.

Accordingly, the shapes of the housing 1 and the fin unit 12 are set so that the cross-sectional areas of the central emission sound D1 and the annular emission sound D2, which propagate in the annular shape, is approximately constant irrespective of the diameter.

Figure 11:
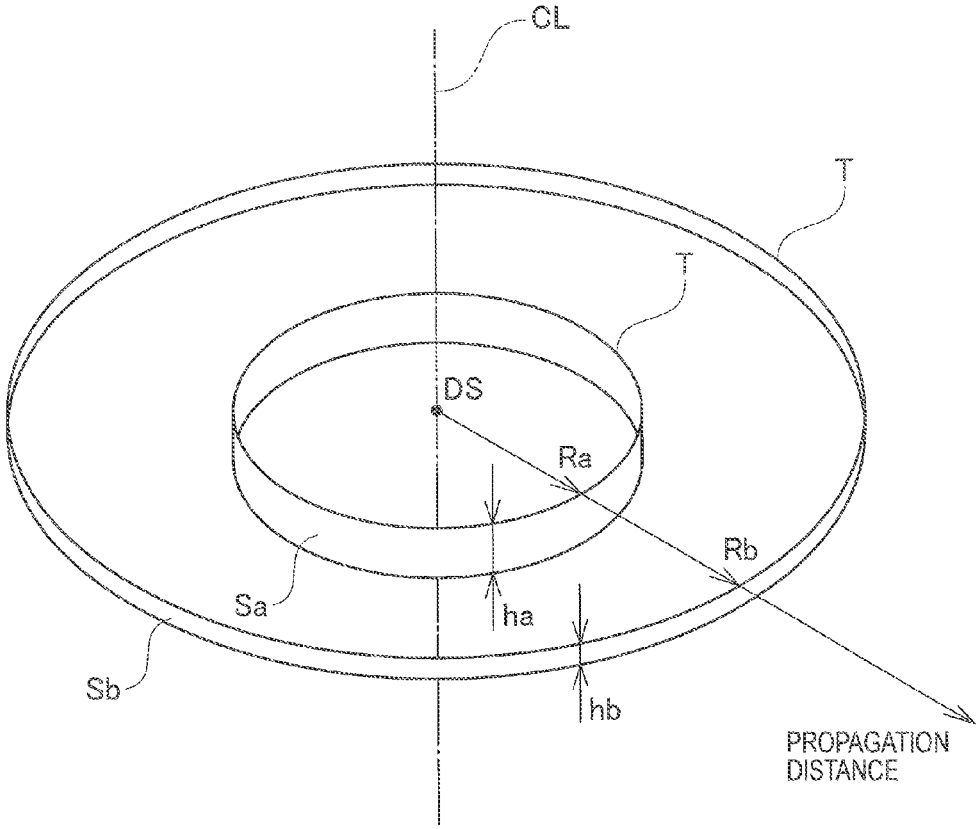
FIG. 11 is a schematic view for explaining a cross-sectional area of a sound which is emitted from a rear of the speaker unit 5 in a sound propagation path in the housing. 1.

FIG. 11 is a perspective view schematically showing a method of constantly setting the cross-sectional areas. In FIG. 11, with regard to a path T of a sound that is emitted from a sound source DS and propagates in an entire circumference direction, a path width thereof at a position where a radius is Ra is defined as ha, and a path width thereof at a position where a radius is Rb larger than Ra is defined as hb.

The cross-sectional area Sa of the path T at the position Ra is represented as $Sa=2\pi Ra\times ha$, and the cross-sectional area Sb of the path T at the position Rb is represented as $Sb=2\pi Rb\times hb$.

In order to establish Sa=Sb is the preferred aspect, Equation (1) needs to be established.

$$hb=(Ra/Rb)\times ha \tag{1}$$

If this method of thinking is applied to the housing 1, then a structure is formed, as shown in FIG. 8. That is, widths in the front/rear direction between the bottom wall 13*a* and the rear-side end portions 12*a*3 to 12*c*3 of the fins 12*a* to 12*c* are defined as widths h12*a* and h12*c*. Moreover, the respective radii of the rear-side end portions 12*a*3 to 12*c*3 are defined as R4E, R5E, and R6E (also refer to FIG. 7).

At this time, path cross-sectional areas S12*a*, S12*b*, and S12*c* at positions of the rear-side end portions 12*a*3 to 12*c*3, are represented as in Equations (2) to (4).

$$S12a=2\pi R4E\times h12a \tag{2}$$

$$S12b=2\pi R5E\times h12b \tag{3}$$

$$S12c=2\pi R6E\times h12c \tag{4}$$

Hence, in order to establish S12*a*=S12*b*=S12*c* that is a preferred aspect, Equations (5) and (6) need to be established.

$$h12b=(R4E/R5E)\times h12a \tag{5}$$

$$h12c=(R4E/R6E)\times h12a \tag{6}$$

That is, the interval (minimum interval) between a maximum-diameter region of the second fin and the rear (bottom wall 13*a*) of the housing 1 (back cover 13) is wider than the interval between a maximum-diameter region of the first fin and the rear (bottom wall 13*a*) of the housing 1 (back cover 13).

The present invention is not limited to the configuration of the above-mentioned embodiments, and is modifiable within the scope without departing from the scope of the present invention.

The headphone device 51 is not limited to the so-called overhead-type including the headband. The headphone device 51 may be other forms of headphones, such as an ear-hanging type headphone, which includes ear-hanging hangers, and are attached to auricles.

The annular sound-emitting portion 5*a*2 does not have to be an annular area that is continuous and perfect. The annular sound-emitting portion 5*a*2 may be formed into a C shape-like or arc-like area having a discontinuous portion. The central sound-emitting portion 5*a*1 and the annular sound-emitting portion 5*a*2 may be composed of plural holes. In this case, the annular sound-emitting portion 5*a*2 is disposed so as to form an annular shape or an arc shape.

Moreover, the fins 12*a* to 12*c* do not have to be continuously and perfectly annular, either, and may be formed into arc shapes.

In the case where any of the above-described fins 12*a* to 12*c* and the annular sound-emitting portion 5*a*2 are combined with each other, in the case where the fin is arc-like and the annular sound-emitting portion 5*a*2 is annular, then the above-mentioned effect is achieved within a range of a circumferential direction of the arc-like fin. On the contrary, in the case where the fin is annular and the annular sound-emitting portion 5*a*2 is arc-like, then the above-mentioned effect is achieved within a range of a circumferential direction of the fin corresponding to the annular sound-emitting portion 5*a*2 that is arc-like.

If the back cover 13 of the housing 1 is regarded as an enclosure, then the speaker SP is composed including the speaker unit 5 and the back cover 13. The speaker SP is also incorporated in the present disclosure.

For example, in the case where the depth of the speaker SP cannot be elongated owing to design restrictions, the speaker SP can obtain a similar effect to that of the headphone device 51 by adopting the configuration of the embodiments, including the above-mentioned fin unit 12.

What is claimed is:

1. A speaker comprising: an open-backed speaker unit; a housing which is disposed so as to cover a rear side of the speaker unit, and forms a back cavity with the speaker unit; and a fin unit, which is disposed in the back cavity, and includes an annular or arc-like first fin expanding in diameter, so as to approach a rear side of the housing as going from a center of the speaker unit, toward an outer diameter side of the speaker unit, thereby establishing a first interval between a maximum-diameter region of the first fin and a rear of the housing; wherein the fin unit comprises an annular or arc-like second fin in which an end portion on the speaker unit side has a shape corresponding to a shape of an inner edge of an annular or arc like area and expands in diameter so as to approach a rear side of the housing as going from a center of the speaker unit toward an outer diameter side, the second fin being located inside the first fin on an inner diameter side, thereby establishing a second interval between a maximum-diameter region of the second fin and the rear of the housing.

2. The speaker according to claim 1, wherein the speaker unit comprises a first sound-emitting portion that emits a sound to the rear in said annular or arc-like area, and an end portion of the first fin on the speaker unit side comes close to an outer edge of the first sound-emitting portion while having a shape corresponding to shape of the outer edge.

3. The speaker according to claim 1, wherein, on the rear, the speaker unit comprises a second sound-emitting portion on an inner diameter side, inside an end portion of the second fin on the speaker unit side.

4. The speaker according to claim 3, wherein the second interval is wider than the first interval.

5. A headphone device comprising:

a pair of the speakers according to claim 1; and a headband that couples the pair of speakers to each other.

* * * * *